US006005347A

United States Patent [19]

Lee

[11] Patent Number: 6,005,347

[45] Date of Patent: Dec. 21, 1999

[54] CATHODE FOR A MAGNETRON HAVING PRIMARY AND SECONDARY ELECTRON EMITTERS

[75] Inventor: Jong-Soo Lee, Kyungki-Do, Rep. of Korea

[73] Assignee: LG Electronics Inc., Rep. of Korea

[21] Appl. No.: 08/761,245

[22] Filed: Dec. 6, 1996

[30] Foreign Application Priority Data

Dec. 12, 1995 [KR] Rep. of Korea ..... 95-48727

[51] Int. Cl.[6] ..... H01J 23/05

[52] U.S. Cl. ..... 315/39.63; 313/103 R

[58] Field of Search ..... 315/39.63, 39.67, 315/39.51, 5.11, 5.12, 5.13; 313/103 R

[56] References Cited

U.S. PATENT DOCUMENTS 3,503,001 3/1970 Farney ..... 315/5.11 X 3,596,131 7/1971 Wilczek ..... 315/39.63 X 5,280,218 1/1994 Smith ..... 315/39.63 X

*Primary Examiner*—Benny T. Lee

*Attorney, Agent, or Firm*—Ostrolenk, Faber, Gerb & Soffen, LLP

[57] ABSTRACT

An improved magnetron which is capable of elongating the life span of the magnetron, reducing the fabrication cost, and enhancing the performance of the system without using a filament in the conventional art, which includes a center lead, an upper end shield engaged to an upper portion of the center lead for preventing thermal electrons from being escaped, a plate-type primary cathode arranged below the upper end shield and fixed to one side of the supporting layer surrounding the center lead, a cylindrical secondary cathode having an elongating slit formed in an outer circumferential surface thereof, through which slit a part of the plate-type primary cathode is outwardly extended beyond the outer circumferential surface of the cylindrical secondary cathode, and a lower end shield engaged to the lower portion of the secondary cathode.

7 Claims, 5 Drawing Sheets

FIG. 1C
CONVENTIONAL ART
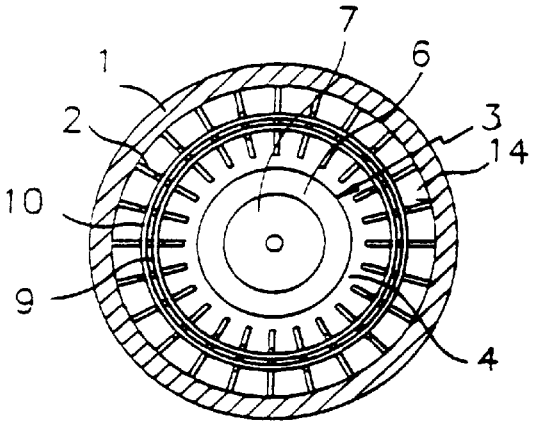
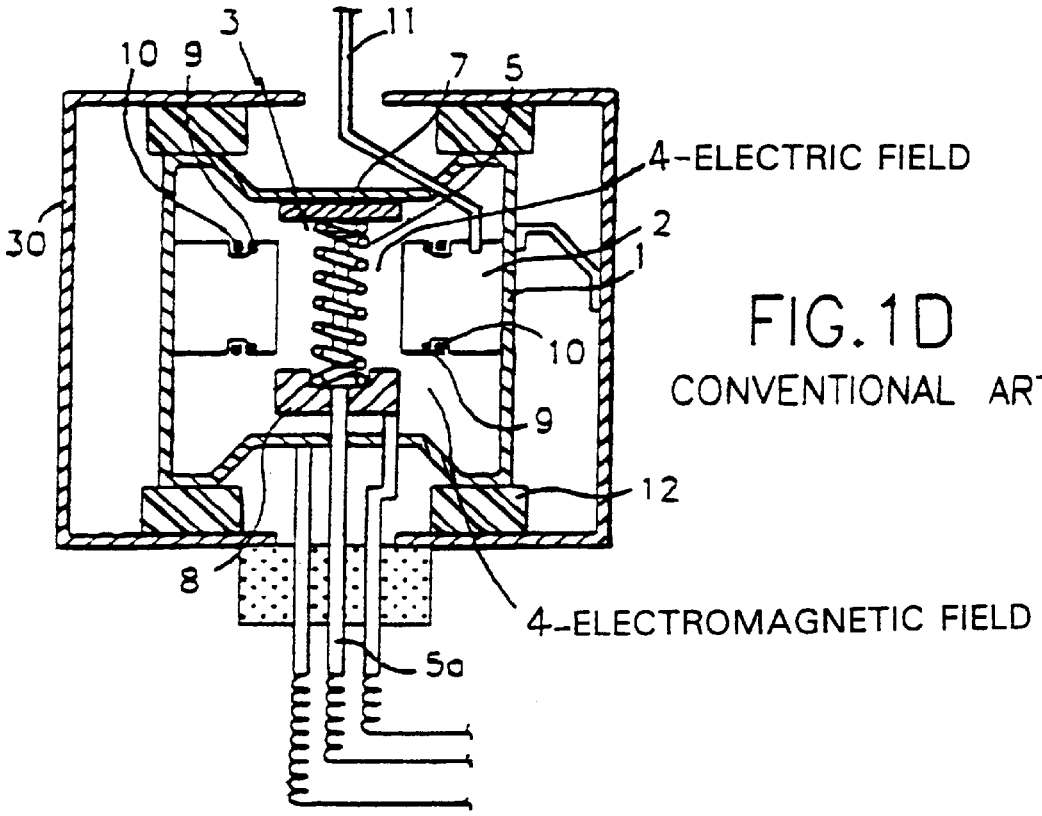
FIG. 1D
CONVENTIONAL ART

CATHODE FOR A MAGNETRON HAVING PRIMARY AND SECONDARY ELECTRON EMITTERS

BACKGROUND OF THE INVENTION

1. Field of the Invention

The present invention relates to a cathode of a magnetron, and in particular to an improved cathode of a magnetron which is capable of increasing the life span of the magnetron, reducing the fabrication cost, and enhancing the performance of the system without using a filament in the conventional art.

2. Description of the Conventional Art

FIG. 1A is a cross-sectional view illustrating a conventional magnetron, and FIG. 1B is a cross-sectional view illustrating a cathode, vanes, and an anode of a conventional magnetron.

As shown therein, a cathode 3 is arranged in the center portion of a yoke 30 (see FIG. 1A) encapsulating inner components of the magnetron.

A cylindrical anode 1 is arranged in the outer portion of the cathode 3, and a plurality of spaced-apart vanes 2 are radially arranged in the anode 1, each outer end of which vanes 2 is fixed to the inner circumferential surface of the anode 1.

In addition, an inner strap ring 9 is arranged on the vanes 2, and an outer strap ring 10 having a greater diameter than that of the inner strap 9 is arranged in the outer side of the inner strap 9.

Here, since the inner strap ring 9 and the outer strap ring 10 are alternately and fixedly engaged to the vanes 2, namely, the vanes 2 to which the inner strap ring 9 is fixedly engaged is not engaged to the outer strap ring 10. Here, the neighboring vanes 2 have a phase difference of 180° from one another and are electrically connected to one another.

The construction of the cathode 3 will now be explained in more detail. As shown in FIG. 1B, an upper end shield 7 for supporting a filament 5 is arranged on the top portion of the filament 5 which is spirally formed so as to effectively radiating electrons.

A rim portion 6 having a larger diameter than the outer diameter of the filament 5 is formed in the upper end shield 7 so as to prevent thermal electrons generated from the filament 5 from escaping to the outside of an interaction space 4.

A lower end shield 8 is arranged in a lower portion of the filament 5 so as to upwardly support the lower portion of the filament 5.

Permanent magnets 12 are arranged in upper and lower portions of the anode 1 as shown in FIG. 1A.

In addition, a resonant portion 14 is formed in a portion surrounded by two neighboring vanes 2 and the anode 1, one side of the resonant portion 14 is open toward the cathode 3, and the resonating frequency of the magnetron is determined in accordance with the resonant frequency.

The operation of the conventional magnetron will now be explained with reference to FIGS. 1A through 1C.

First, a voltage is supplied to the cathode 3, an electric field is generated between the cathode 3 and the vanes 2 in the operational space 4, and an electricmagnetic field is generated in the direction parallel to a center stem 5*a* of the cathode 3 as shown in FIG. 1B.

Therefore, a high frequency electric field is generated in the LC resonant portion 14 (see FIG. 1C) and is focused to an end portion of each vane 2, and a part of the high frequency electric field is leaked into the interior of the interaction space 4.

In addition, since the inner strap ring 9 and the outer strap ring 10 are alternately engaged to the vanes 2, an electric potential is rapidly changed between the vanes 2, and the electrons radiated from the cathode 3 circles in the interaction space 4 and interacts with the high frequency electric field therein, for thus oscillating microwaves.

In addition, the oscillated microwaves are transferred to the outside of the magnetron through an antenna 11 connected to the vanes 2. Here, since a part of electrons is changed into heat energy, cooling fins 13 (see FIG. 1A) are arranged in the outer portion of the anode 1 so as to prevent the temperature from being increased due to the heat applied thereto.

As shown in FIG. 1A, a filter box 20 having a choke coil 21 and a through type condenser 22 is arranged below the yoke 30 for preventing the leakage of a unnecessary radiating wave which causes an interference with respect to a communication system such as a television, a radio, etc. when an electric wave having a range of 2450 MHz including a range from hundreds of KHz to tens of GHz is generated when a voltage is applied to the system as shown in FIG. 1D.

The conventional magnetron which uses the filament has the following disadvantages.

First, since a current is applied to heat the filament, a filament voltage supply system is additionally necessary, and since the filament becomes activated at a temperature of about 1700°, a center lead, a side lead, and other elements which support the filament should be made of an expensive molybdenum having a high melting point.

Second, since about 30 W through 50 W is consumed so as to heat the filament, the efficiency of the magnetron is degraded.

Third, since the heat source of about 1700° C. is transferred to the choke coil through the center lead, the side lead, etc, it is impossible to thermally control the choke coil.

Fourth, it is impossible to effectively cool the magnetron because the resonant space in which the cylindrical anode body and vanes are arranged is heated therein due to the heat from the cathode having a temperature of about 1700° C.

Fifth, since the strength of the filament is very weak, it may be easily damaged by external impact, so that the life span of the magnetron is shortened.

Sixth, since the filament is operated after a lapse of a predetermined time after a voltage is supplied to the filament, electric wave noise occurs during the abnormal operation, thereby degrading the performance of the magnet.

SUMMARY OF THE INVENTION

Accordingly, it is an object of the present invention to provide a cathode of a magnetron which overcomes the problems encountered in the conventional art.

It is another object of the present invention to provide an improved cathode of a magnetron which is capable of elongating the life span of the cathode of a magnetron, reducing the fabrication cost, and enhancing the performance of the system without using a filament in the conventional art.

To achieve the above objects, in accordance with a first embodiment of the present invention, there is provided a cathode of a magnetron, which includes a center lead, an upper end shield engaged to an upper portion of the center lead for preventing electrons from escaping, a plate-type primary cathode arranged below the upper end shield and fixed to one side of the supporting layer surrounding the center lead, a cylindrical secondary cathode having an elongating slit formed in an outer circumferential surface thereof, through which slit a part of the plate-type primary cathode is outwardly extended beyond the outer circumferential surface of the cylindrical secondary cathode, and a lower end shield engaged to the lower portion of the secondary cathode, whereby a small amount of electrons is radiated from the primary cathode when a voltage is supplied to the first cathode, and the electrons collide with the outer wall of the cylindrical secondary cathode through the slit, thereby radiating a large amount of electron in cooperation with the collision energy between the electrons and the outer wall of the cylindrical secondary cathode.

To achieve the above objects, in accordance with a second embodiment of the present invention, there is provided a cathode of a magnetron, which includes a center lead, an upper end shield engaged to an upper portion of the center lead for preventing electrons from escaping, a primary cathode radially fixed to an outer edge portion of the upper end shield radially, a cylindrical secondary cathode surrounding the center lead, a vertical plate type field emission cathode fixed to the outer circumferential surface of a cylindrical secondary field emission cathode and protruding beyond each slit formed between neighboring primary cathode, and a lower end shield engaged to the lower portion of the secondary cathode.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1C is a horizontal cross-sectional view illustrating the cathode, the vanes, and the anode of FIG. 1;

FIG. 1D is a detailed cross-sectional view illustrating a conventional magnetron.

DETAILED DESCRIPTION OF THE INVENTION

The cathode of a magnetron according to a first embodiment of the present invention will now be explained with reference to FIGS. 2A and 2B.

As shown therein, a cathode of the magnetron according to the first embodiment of the present invention includes a vertical plate type field emission cathode (FEC) (a primary cathode) 113, and a hollow secondary emission body (SEB) (a secondary cathode) 114.

The primary cathode 113 arranged below an upper end shield 116 (see FIG. 2A) for preventing the leakage of thermal electrons is fixed to a portion of a supporting layer 117 surrounding a cylindrical center lead 111.

Figure 1A:
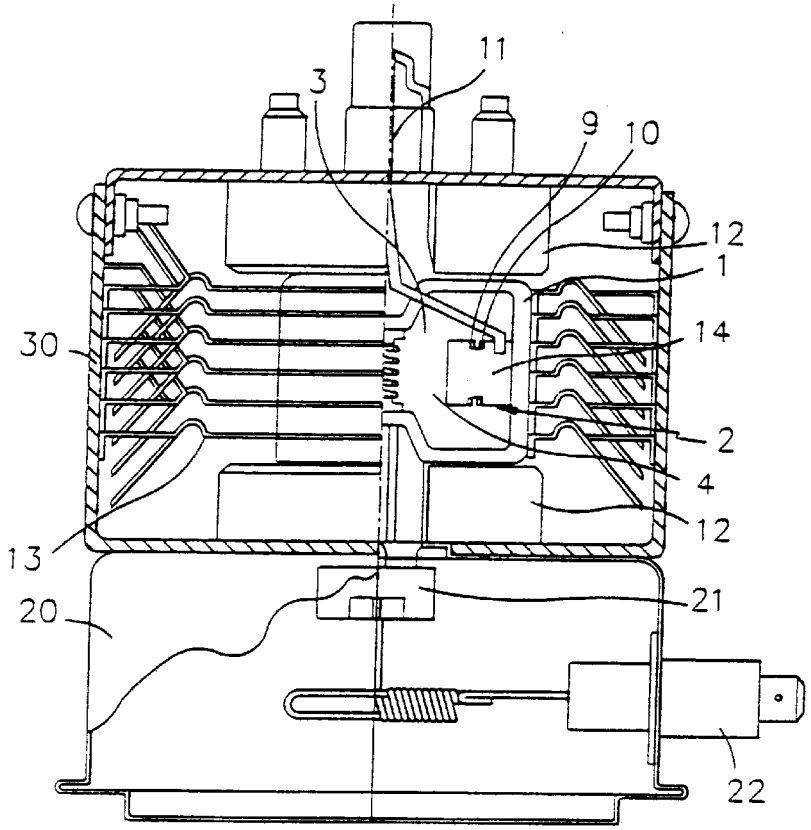
FIG. 1A CONVENTIONAL ART
FIG. 1A is a cross-sectional view illustrating a conventional magnetron.
Figure 1B:
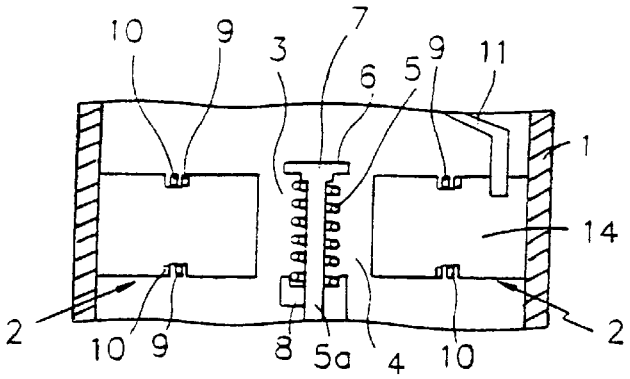
FIG. 1B CONVENTIONAL ART
FIG. 1B is a cross-sectional view illustrating a cathode, vanes, and an anode of a conventional magnetron.
Figure 2A:
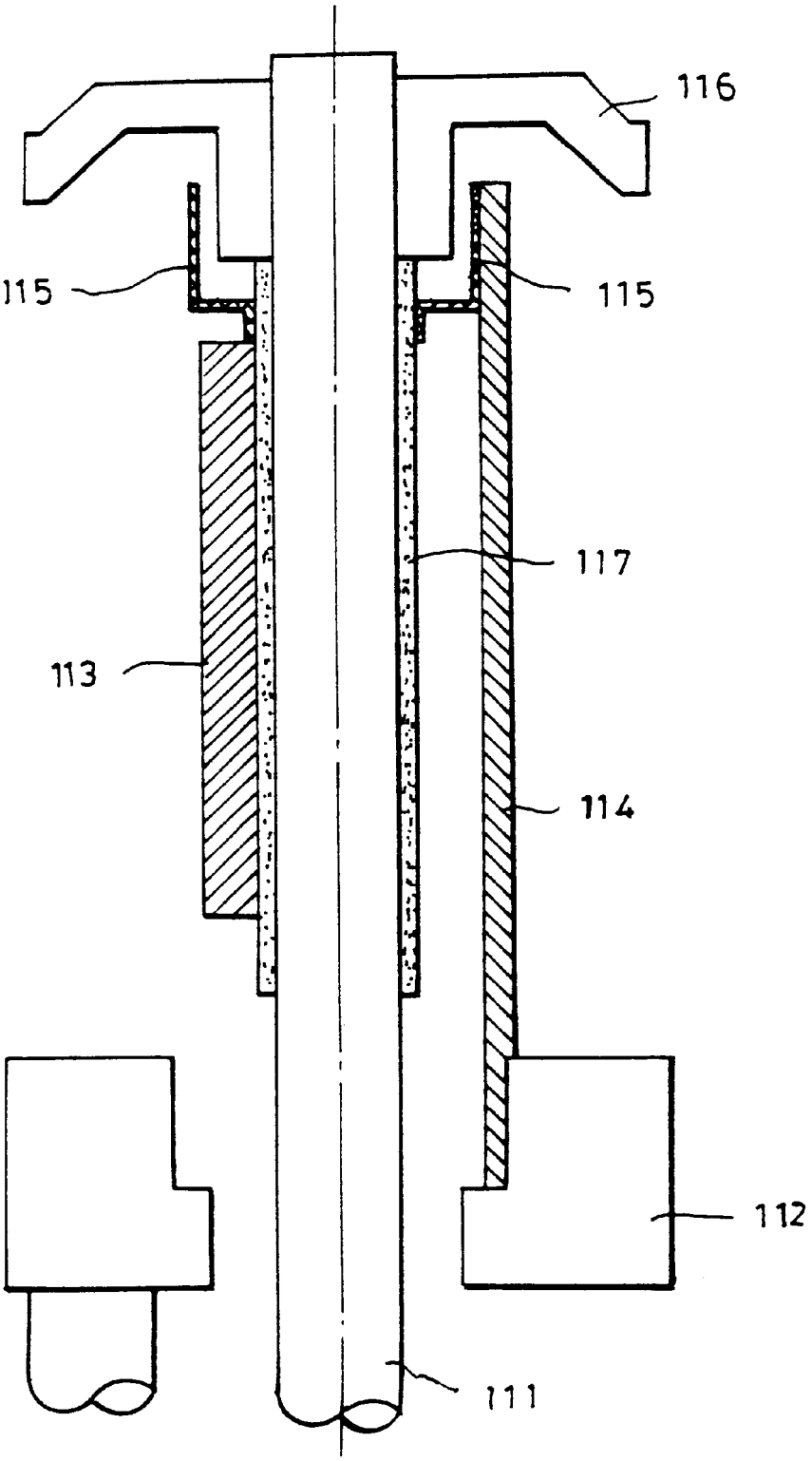
FIG. 2A vertical cross-sectional view illustrating the construction of a cathode of a magnetron according to a first embodiment of the present invention.
Figure 2B:
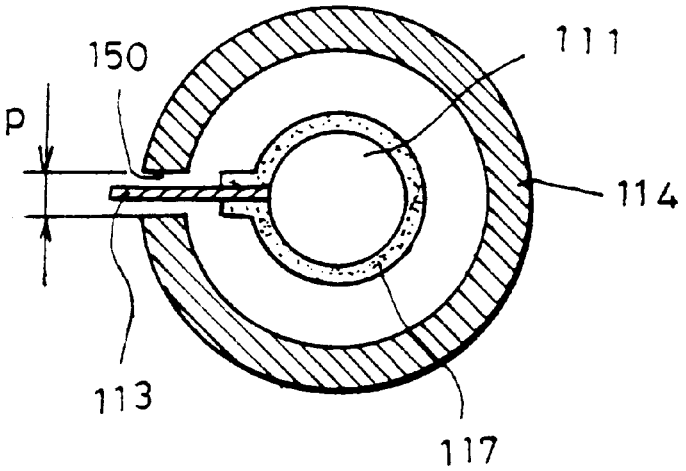
FIG. 2B is a horizontal cross-sectional view taken along line A—A of FIG. 2A illustrating the construction of the cathode of FIG. 2A according to the present invention.

Here, one lengthy side of the primary cathode 113, as shown in FIG. 2B, is fixedly inserted into a portion of the supporting layer 117, with another lengthy side of the primary cathode 113 being extended through an elongated slit 150 formed in the outer circumferential surface of the secondary cathode 114.

If a voltage is supplied to the primary cathode 113, a small amount of electrons is radiated from the primary cathode 113.

In addition, the cylindrical secondary cathode 114 surrounds the supporting layer 117.

Namely, the cylindrical secondary cathode 114, the supporting layer 117, and the slit 150 have a predetermined shaped construction therebetween so that when a small amount of electrons is radiated from the primary cathode 113 and is circled near the slit 150, and the electrons collide with the outer wall of the secondary cathode 114, whereby a large amount of electrons can be obtained in cooperation with a collision energy which occurs during the collision between the electrons and the outer wall of the secondary cathode 114.

As shown in FIG. 2A, a secondary cathode activation apparatus 115 for activating the secondary cathode 114 is arranged between the primary cathode 113 and the secondary cathode 114, with opposite ends of the secondary cathode activation apparatus 115 contacting with the primary cathode 113 and the secondary cathode 114, respectively.

The supporting layer 117 is made of either Ni or Zr which has a high strength. Here, the secondary cathode activation apparatus 115 is used for supplying a voltage to the secondary cathode 114. After the activation of the secondary cathode 114, the secondary cathode activation apparatus 115 is removed.

That is, the secondary cathode activation apparatus 115 electrically connects the primary cathode to the secondary cathode when the cathode of the magnetron is manufactured. When power is applied to the primary cathode and the secondary cathode in order to activate the secondary cathode, the secondary cathode activation apparatus 115 is removed after a predetermined time has passed, and thus the primary cathode 113 and the secondary cathode 114 are electrically disconnected.

In FIG 2A, reference numeral 112 denotes a lower end shield.

Figure 3:
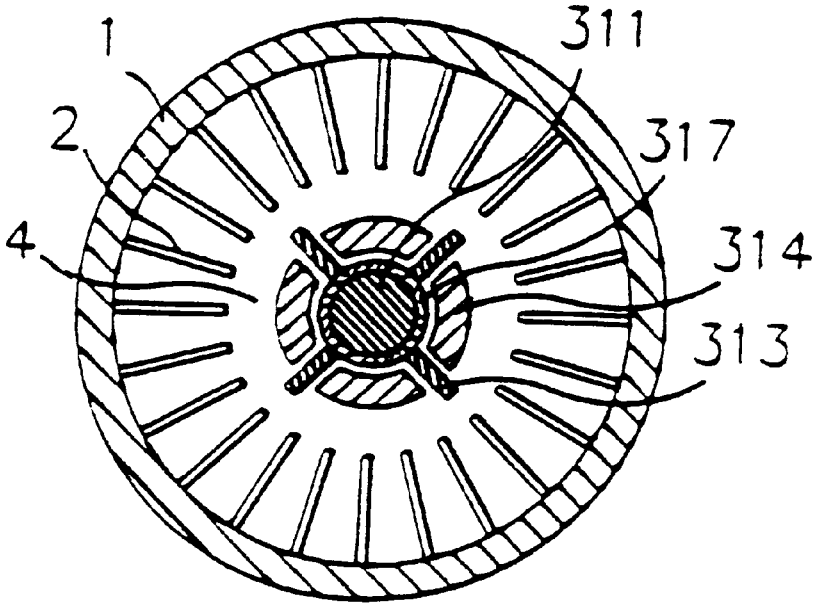
FIG. 3 is a horizontal cross-sectional view taken along line A—A of FIG. 2A illustrating the construction of cathode of a magnetron according to a second embodiment of the present invention.

In the cathode of the magnetron according to the second embodiment of the present invention, as shown in FIG. 3, a plurality of first cathodes 313 arranged below an upper end shield 116 (see FIG. 2A) for preventing the leakage of a thermal electron are fixed to the multiple portions of a supporting layer 317 surrounding a cylindrical center lead 311. Here, one lengthy side of the first cathodes 313, as shown in FIG. 3, is fixedly inserted into the supporting layer 317, and another lengthy side of the first cathodes 313 is extended through each elongated slits formed between neighboring second cathodes 314.

In the second embodiment of the present invention, a secondary cathode activation apparatus 115 is arranged between the inner surface of an end shield 116 and the cylindrical secondary cathode 314. Identically to the first embodiment of the present invention, the secondary cathode activation apparatus 115, which is basically used so as to supply a predetermined voltage to the secondary cathode, is removed after the fabrication of the magnetron.

Therefore, in the second embodiment of the present invention, when a predetermined voltage is supplied to the primary cathode, a small amount of electrons is radiated therefrom. The electrons radiated from the primary cathode circles and collides with the outer wall of the secondary cathode, for thus radiating a large amount of electrons in cooperation with a collision energy between the electrons and the outer wall of the secondary cathode.

In addition, the material of the primary cathode satisfies the following conditions.

First, the primary cathodes 113, and 313 are comprised of a material having a lower work function, which is capable of radiating electrons even when a lower voltage is supplied thereto ($\phi<3$ eV).

In more detail, generally, it is known that oxygen combination serves to increase the work function of the material. As a chemical combination of oxygen, there are a passivation and an oxidation in a metallic and semiconductor field at lower temperature.

Here, the porosity coefficient $\alpha$ is obtained through the following equation.

$$\alpha=n(Vok/Vo\mu) \quad (1)$$

where Vok denotes a molecular size of oxygen, $Vo\mu$ denotes a nuclear size, and n denotes a ratio between the number of atoms of a metal and the number of all atoms of oxygen molecular.

When the porosity coefficient $\alpha$ is less than 1, a porous layer is formed during an oxidation, through porous layer oxygen can easily penetrate into the metal.

When the porosity coefficient $\alpha$ is greater than 1, an intensive layer of the oxide material is formed during the oxidation, so that the penetration of the oxygen into the metal is not performed.

Second, since the thermal characteristic of a material of the primary cathodes 113, and 313 is determined by the temperature characteristic of the primary cathodes 113, and 313, the strength, an electrical conductivity, and a thermal conductivity must be high.

The materials which satisfy the above-described conditions are Ta, Nb, Si, Al, etc.

Figure 4A:
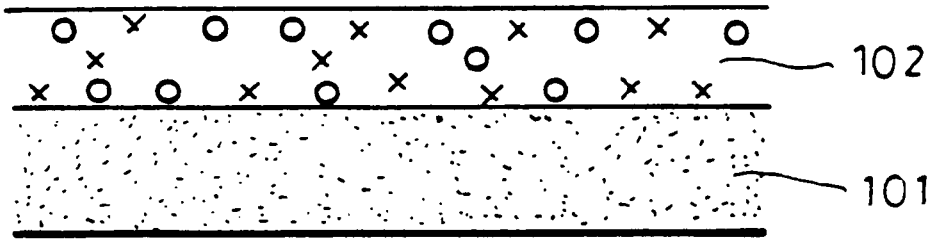
FIG. 4A is a cross-sectional view illustrating a secondary cathode of a magnetron according to the present invention so as to explain an ion activation state.
Figure 4B:
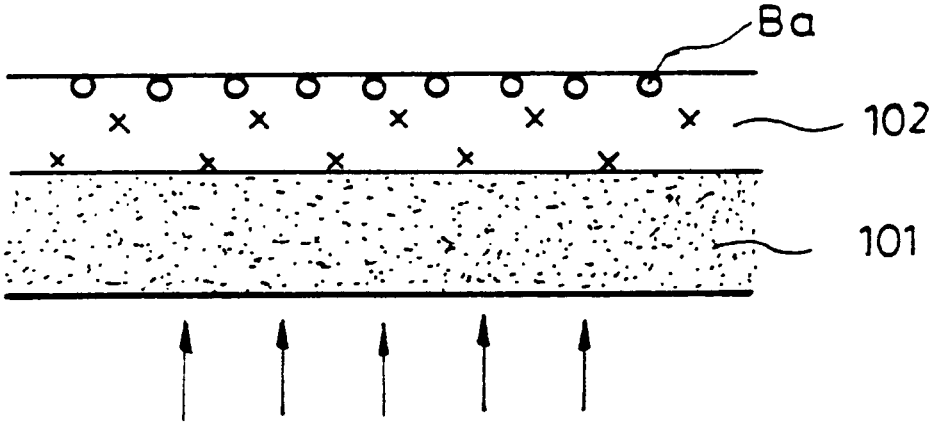
FIG. 4B cross-sectional view illustrating the secondary cathode of FIG. 4A when the secondary cathode is heated by an activation device up to a predetermined temperature so as to explain the rearrangement of ions.

In addition, the secondary cathodes 114 and 314, as shown in FIGS. 4A and 4B, include a base layer 101 and an outer layer 102, and the base layer 101 is formed of one selected from the group comprising Ni and Zr, and the outer layer 102 is formed of one selected from the alloy group comprising an alloy of Ba and Al, an alloy of Pd and Ba, and an alloy of Re and La.

On the assumption that the alloy of Ba and Al is used, at the initial stage, Ba and Al are mixed with each other. When heating the outer layer 102 by applying a predetermined voltage thereto by using the secondary cathode activation apparatuses 115 and 215 up to 400° C.~600° C., as shown in FIG. 4B, Ba gathers at an edge portion of the outer layer, for thus activating the outer layer, whereby it is possible to increase the electron radiation effect.

As described above, the cathode of a magnetron according to the present invention does not use the filament which was used in the conventional art as a key element. Namely, when a predetermined voltage is supplied to the primary cathode, the primary cathode radiates a small amount of electrons, and the electrons collide with the outer wall of the secondary cathode, for thus radiating a large amount of electrons. In other words, the magnetron according to the present invention provides a double structure of primary and secondary cathodes, for thus removing the filament compared to the conventional art, whereby it is possible to increase the life span of the product, reduce the fabrication cost, and improve the performance of the product.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A cathode for a magnetron, comprising:

a center lead;

an upper end shield engaging a portion of the center lead and electrically connected to the center lead;

a plate-type primary cathode fixed to the center by a supporting layer surrounding the center lead and electrically connected to the center lead;

a cylindrical secondary cathode having a slit, and through the slit an end of the plate-type primary cathode is outwardly extended beyond an outer surface of the cylindrical secondary cathode; and a lower end shield engaged to a portion of the cylindrical secondary cathode and electrically connected to the cylindrical secondary cathode, whereby a small amount of electrons is radiated from the end of the plate-type primary cathode when a voltage is supplied to the center lead, and the electrons collide with the outer surface of the cylindrical secondary cathode, and thus a large amount of electrons is radiated from the outer surface of the cylindrical secondary cathode.

2. The cathode for a magnetron of claim 1, further comprising a cylindrical secondary cathode activation apparatus arranged between the center lead and the cylindrical secondary cathode, with respective ends of the secondary cathode activation apparatus respectively contacting the center lead and the secondary cathode.

3. The cathode for a magnetron of claim 1, wherein said cylindrical secondary cathode includes a base layer and an outer layer.

4. The cathode for a magnetron of claim 3, wherein said base layer is comprised of a material selected from the group comprising Ni and Zr.

5. The cathode for a magnetron of claim 3, wherein said outer layer is comprised of a material an alloy selected from the group comprising an allow of Ba and Al, an alloy of Pd and Ba, and an alloy of Re and La.

6. The cathode for a magnetron of claim 1, wherein said plate type primary cathode is comprised of a material selected from the group comprising Ta, Nb, Si, and Al.

7. The cathode for a magnetron of claim 1, wherein said plate-type primary cathode is extended up to a portion between the outer surface and an inner circumferential surface of the cylindrical secondary cathode.

* * * * *